United States Patent [19]

Gladwin

[11] Patent Number: 4,694,880

[45] Date of Patent: Sep. 22, 1987

[54] METHOD OF CONTINUOUSLY CASTING METAL SLABS

[76] Inventor: Kirk M. Gladwin, c/o Gladwin Corporation, 20401 Gladwin Ave., Taylor, Mich. 48180

[21] Appl. No.: 418,888

[22] Filed: Sep. 16, 1982

[51] Int. Cl.[4] ..... B22D 11/04

[52] U.S. Cl. ..... 164/459; 164/418

[58] Field of Search ..... 164/418, 424, 435, 459

[56] References Cited

U.S. PATENT DOCUMENTS

| | | | |
|---|---|---|---|
| 3,321,008 | 5/1967 | Jones | 164/435 |
| 3,563,298 | 2/1971 | Stauffer et al. | 164/418 X |
| 3,837,392 | 9/1974 | Rossi | 164/424 |
| 3,910,342 | 10/1975 | Johnson | 164/418 |
| 3,978,909 | 9/1976 | Schoffmann | 164/418 |
| 4,023,612 | 5/1977 | Jackson | 164/418 |
| 4,207,941 | 6/1980 | Shrum | 164/459 X |
| 4,249,590 | 2/1981 | Willim | 164/418 |

FOREIGN PATENT DOCUMENTS

| | | | |
|---|---|---|---|
| 2409820 | 9/1975 | Fed. Rep. of Germany | 164/418 |
| 1492047 | 8/1967 | France | 164/418 |
| 0014628 | 2/1978 | Japan | 164/418 |
| 56-53849 | 5/1981 | Japan | 164/459 |
| 57-79047 | 5/1982 | Japan | 164/418 |
| 0908490 | 2/1982 | U.S.S.R. | 164/418 |
| 0923728 | 4/1982 | U.S.S.R. | 164/418 |

*Primary Examiner*—Nicholas P. Godici
*Assistant Examiner*—J. Reed Batten, Jr.
*Attorney, Agent, or Firm*—Cullen, Sloman, Cantor, Grauer, Scott & Rutherford

[57] ABSTRACT

Metal slabs are continuously cast in a mold defined by a plurality of mold plates arranged to provide a mold cavity therebetween with the mold cavity open at the top and bottom. The mold surfaces which face the cavity are curved convexly and the degree of curvature changes at a non-linear rate along the height of the mold cavity.

3 Claims, 7 Drawing Figures

METHOD OF CONTINUOUSLY CASTING METAL SLABS

BACKGROUND OF THE INVENTION

This invention relates generally to continuous casting of metal slabs such as steel and, more particularly, to improved mold plates for such continuous casting.

In the continuous casting of metal slabs such as slabs of steel, a stream of molten metal is typically poured downwardly into a tube-like mold. As the molten metal stream flows through the mold, the mold sufficiently cools the metal so as to form a skin on the outer surfaces of the flowing molten metal. The molten metal enclosed within the skin continues to advance, usually downwardly in a gravity-assisted direction, through cooling zones and once the moving stream of metal is solidified into a continuous slab it may be cut into slab lengths. The initial formation and cooling of the molten metal stream takes place in a mold which typically shapes the metal into a generally rectangular cross-sectional configuration.

Examples of typical size slabs which may be continuously cast in such molds range from between about 8 to 104 inches in width and about 4 to 12 inches in thickness with the slab being cut off the continuously forming slab stream to the desired lengths. Once the metal is solidified, the wider slabs may also be cut longitudinally to form narrower slabs.

In the mold, the rate and thickness of the skin formation varies depending upon the speed of movement of the metal stream through the mold, the cooling temperature of a coolant flowed through the mold walls, the metal composition, etc. By way of approximation, a skin thickness of between about 3/16 of an inch to ½ inch may be formed with the skin surrounding a molten metal interior which interior solidifies as the metal advances through subsequent cooling zones exterior of the mold. The molten metal within the skin of the moving stream exerts a considerable ferrostatic pressure that tends to cause the sides of the moving stream to bulge outwardly and often tends to cause the corners of the skin to burst. This is referred to as break-out.

Once the partially solidified moving stream exits from the mold, the metal is conveyed through a cooling zone by rollers of the like and efforts have been made to reduce and/or eliminate the bulging out of the metal stream by the use of rollers engaging the metal just below the mold. These rollers do tend to resist bulging of the metal but the rollers increase the drag or frictional resistance applied to the metal stream, thereby requiring more powerful motors to move the continuous cast metal slab. In addition, because of the bulging or side expansion of the skin by the ferrostatic pressure, it is difficult to hold the dimensions of the metal slab within the desired tolerances without the use of edge rollers or guides.

When the molten metal is in the mold and is in contact with the mold walls, as the skin or outer surfaces of the molten metal starts to cool, the molten metal contracts away from the mold walls. After the molten metal has contracted out of contact with the mold wall, the heat from the interior of the molten metal causes the metal to expand until the metal is again in contact with the mold wall. Thereafter, the metal in contact with the mold wall cools and again shrinks or contracts out of contact with the mold wall. This repetitive contraction and expansion occurs while the molten metal flows downwardly through the mold and thus creates a wavy surface irregularity on the metal slab as well as causing uneven wear on the mold walls.

The prior art patent to Johnson, U.S. Pat. No. 3,910,342, issued Oct. 7, 1975, discloses one technique for minimizing break-out and for providing a slab with flat surfaces. The Johnson patent describes a mold where the interior walls of the mold are convex and where the radius of curvature of the convex mold surface is progressively greater at successive lower levels of the mold passage. The purpose of this configuration is to prolong contact between the flowing metal and the mold walls. The Johnson patent suggests that the radius of curvature at the bottom of the mold may be infinity so that the surface of the metal casting as it leaves the mold will be flat.

U.S. Pat. No. 3,837,392, issued to Rossi on Sept. 24, 1974, is directed to another attempt to solve the problem of non-flat slab surfaces by providing a convex roller to engage the metal strand as the metal strand exits from the mold, the convex roller working in conjunction with cooling sprays to achieve the desired flat surface and cross-sectional configuration of the finished slab. The Rossi patent also discloses the idea of convex configuration of the mold walls in lieu of a convex roller.

U.S. Pat. No. 4,023,612 to Jackson, issued May 17, 1977, describes a technique where flat, inwardly tapered mold wall surfaces have been used and also describes a mold system where flat inwardly tapered mold end walls have a slightly convex intermediate section on each mold end wall. The convex section is uniform along the height of the mold. In a modified version of the apparatus described in the Jackson patent, the side walls are initially flat and thereafter progress from the upper end of the mold to the lower end of the mold with convex sections of progressively increasing height and length.

I have discovered that none of the systems described in these prior art patents provide the desirable solution to the aforementioned problems.

SUMMARY OF THE INVENTION

I have discovered that the aforementioned prior art has utilized an incorrect solution to the aforementioned problems. The solution of the problems which I have discovered is so significant that it is no longer necessary to utilize convex shaping rollers when the molten slab is initially withdrawn from the mold and the problems of bulging or break-out are eliminated. In addition, the surfaces of the slab are flat, smooth rather than irregular, and uneven wear of the mold walls is substantially reduced if not eliminated completely. Thus, the present invention is directed to a new approach of controlling the cross-sectional configuration of a cast metal slab.

The invention herein contemplates an improved mold configuration for the continuous casting of molten metal slabs while beginning solidification within the mold by providing mold walls which have curved surfaces with the radius of curvature generally decreasing from the top of the mold to the bottom of the mold at a non-linear rate. Thus, the thickness of the curved portion of the mold increases toward the mold cavity from the top of the mold toward the bottom of the mold at a non-linear rate. The present invention may be utilized on either two opposed mold walls or all four mold walls.

By the use of the unique mold plates as descirbed herein, as the molten metal is cast the skin forms with concave surfaces. The ferrostatic pressure of the molten metal within the skin formed in the cooling mold tends to force the inwardly curved or concave sides of the skin outwardly. The configuration of the mold maintains the mold in contact with the molten metal skin notwithstanding that the molten metal is alternately shrinking and expanding to thereby eliminate the wavy surface irregularities on the molten slab, eliminating uneven wear of the mold wall surfaces, and preventing bulging or break-out of the molten slab. Thus, for all practical purposes, the cast metal slab will be of the desired configuration upon cooling.

BRIEF DESCRIPTION OF THE DRAWINGS

The various objects and advantages of the present invention, together with other benefits which may be attained by its use, will become apparent upon reading the following detailed description of the invention taken in conjunction with the drawings. In the drawings, wherein like reference numerals identify corresponding parts.

DETAILED DESCRIPTION OF THE INVENTION

Figure 1:
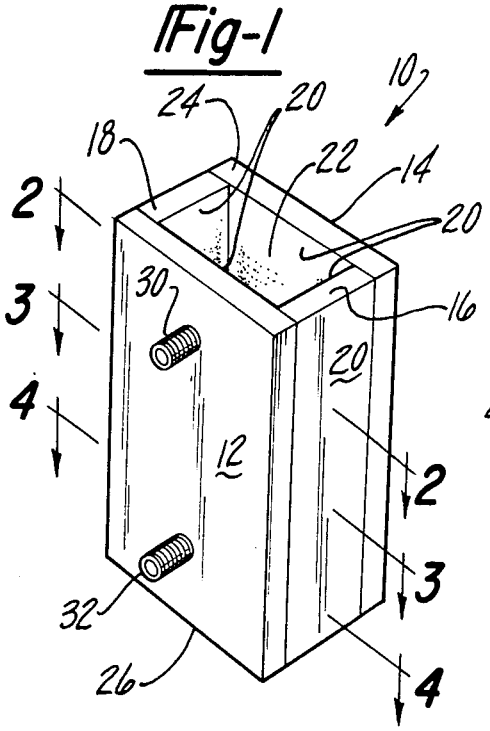
FIG. 1 is a perspective illustration of a continuous casting mold according to the principles of the present invention.
Figure 5:
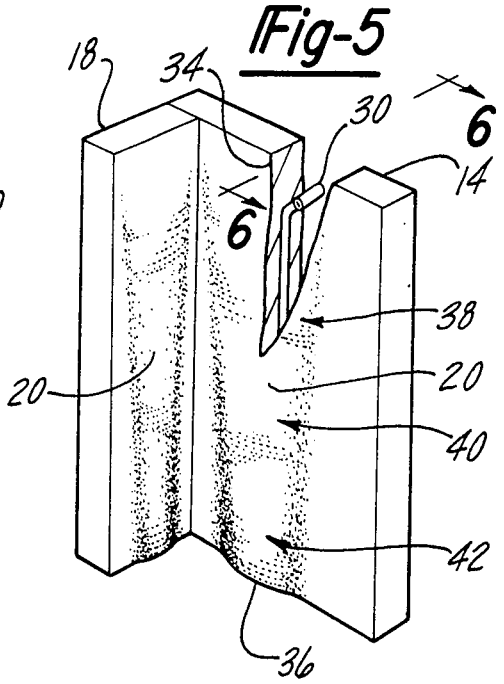
FIG. 5 is a perspective illustration of a mold plate according to the prineiples of the present invention.
Figure 2:
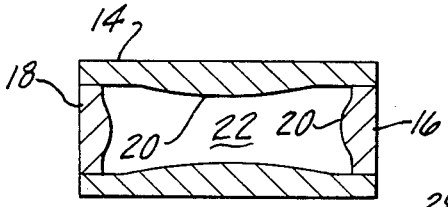
FIGS. 2, 3 and 4 are successive sectional views of the mold of FIG. 1 taken in the plane defined by arrows 2—2, 3—3 and 4—4, respectively.
Figure 3:
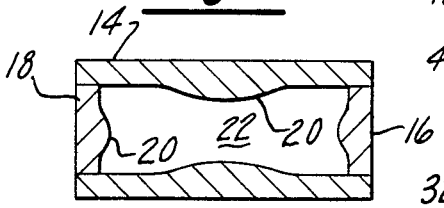
Figure 4:
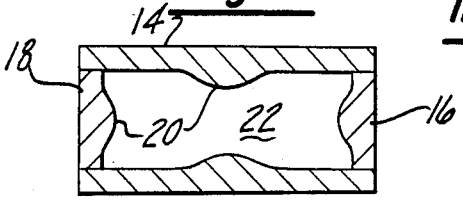

FIG. 1 illustrates, in perspective, the improved mold 10 of the present invention. The mold 10 may be used in a conventional, continuous metal casting operation such as where molten metal in a supply container is emptied into a hopper or tundish which, in turn, empties the molten metal into the mold 10. The molten metal flows through the mold as a continuously moving stream of metal and as the molten stream exits from the lower end of the mold 10 water is sprayed onto the molten metal to cool the molten metal and the cooled metal slab is guided by rollers in a curved path from vertical to horizontal. Thereafter, the cooled slab may be cut to desired lengths.

The mold 10 of the present invention is illustrated as being of generally rectangular configuration, although the mold configuration may be square. In the metal casting industry, the term "billet" is often used to refer to a metal casting of square cross-section up to about 7 inches square. The term "bloom" is often used to refer to a metal casting of square cross-section from about 7 to about 13 inches square. The term "slab" is used to refer to rectangular castings from about 4 to 12 inches in thickness and from about 8 to 104 inches in width. The present invention may be used for either square or rectangular castings and is not restricted to the sizes given above. Hence, the term rectangular is used in the generic sense to include square castings. The mold is provided with a pair of opposed large side plates 12, 14, and a pair of smaller spaced apart end plates 16, 18. Each of the mold plates may include a facing 20 and the four mold plates (or the mold plate facings) define an interior mold cavity 22. The mold is open at the top 24 and open at the bottom 26 to define a roughly rectangular, hollow configuration tube. The mold plate facings are typically formed of a copper material and the mold plates including the facings have cooling passages 28 therein for the passage of a cooling fluid such as water. Each mold plate would have a cooling inlet 30 and cooling outlet 32 so that water may enter through the inlet 30, flow through the interior of the mold plate and exit from the cooling outlet 32 to thus cool the molten metal in the mold so that a skin forms on the cast molten metal. The overall height of the mold is typically 30 inches.

As a continuous stream of molten metal is introduced into the top of a mold, the molten metal contacts the mold walls which mold walls are provided with a coolant flowing therein. The molten metal cools to form a skin or shell with a molten interior and, according to the prior art, this skin, which is partly solidified, tends to contract away from the mold wall. Thereafter, since the skin is not in contact with the mole wall, there is a reduced amount of cooling and the skin tends to expand back into contact with the mold wall, because of the heat from the molten interior of the metal stream, causing a surface irregularity or waviness on the exterior surface of the metal slab.

The present invention overcomes this problem by providing a mold wall where the facings or portions of the mold wall which define the cavity are uniquely configured to maintain contact with the moving metal stream, along the entire length of the mold cavity, and also to form the metal stream in a configuration such that as the metal stream exits from the bottom 26 of the mold, ferrostatic pressure of the still-molten center of the stream causes the molten metal to expand to the desired configuration having flat smooth exterior surfaces.

The present invention may be utilized on the end plates 16, 18 of the mold, on the side plates 12, 14 of the mold, or on all four plates of the mold. The unique configuration of the interior surface of the mold plates will now be described in conjunction with a single such mold plate.

The mold plate facing is generally flat as at 34 at the top of the mold 24 and is generally convex as at 36 at the bottom 26 of the mold. Along the height of the mold facing 20, measured from the top 24 to the bottom 26 of the mold cavity, the mold wall facing is provided with a gradually developing convex configuration, the radius of curvature of which decreases from the upper portion of the facing 38, toward the middle 40 and thereafter toward the lower portion 42 of the mold facing. This progressive decrease in the radius of curvature is non-linear, preferably with a greater degree of change in the radius of curvature in the top one-third of the mold.

Figure 6:
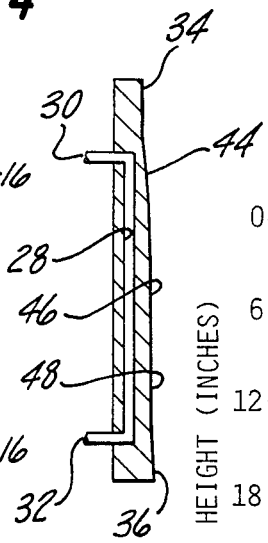
FIG. 6 is a sectional view of the mold plate of FIG. 5 as seen in the plane of arrows 6—6 of FIG. 5.

If the curvature of the mold wall facing is measured from a vertical plane or section through the mold plate and toward the cavity at a point intermediate the side edges of the mold plate, i.e., at the maximum degree of curvature at any specific elevation within the mold, the thickness of the facing increases in a non-linear progression from the top 24 of the mold to the bottom 26 of the mold. The thickness is illustrated at 44, 46 and 48, in FIG. 6 corresponding to the changing radius of curvature at elevations 38, 40 and 42, respectively.

According to the prior art, when a flat tapered mold wall facing was provided, the degree of taper for each mold wall was approximately 1%. Thus, for a mold of approximately 30 inches in height, the cavity at the bottom of the mold would be 0.3 inches narrower for each mold wall which was provided with such a taper. According to the prior art, this taper was linear.

According to the prior art, where curved end plates were used, the taper was between 0.8% and 1%, i.e., for a 30-inch high mold, the amount of taper from a single mold plate would be 0.24–0.30 inches. Again, the taper was linear along the length of the mold.

Figure 7:
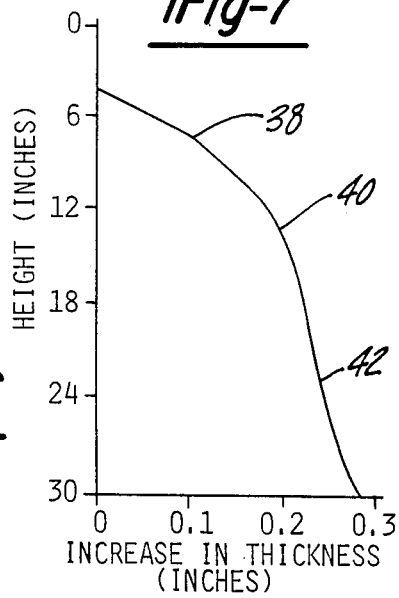
FIG. 7 is a graph illustrating the non-linear progressive change in the curvature or degree of thickness of the mold plate as a function of the depth of the mold measured from top to bottom.

FIG. 7 is a graph showing the preferred curvature at the apex or center ofthe curved mold facing, the center being defined at a mold wall facing halfway between the adjacent mold wall facings. This curvature is thus measured at the narrowest portion of the gravity for a given elevation within the cavity. Equally, this is the position within the convex facing which is of the greatest thickness. The vertical axis of the graph is the height of the mold wall cavity in inches, measured from the top of the cavity. The horizontal axis on the graph is the thickness of the mold wall facing measured in tenths of an inch from a flat vertical plane.

Thus, if the mold wall itself is angled from the vertical, the graph reflects the combined effect of both such angle plus the non-linear convex surface. The convexity of the mold wall facing is essentially zero for approximately the first four inches from the top of the mold measured toward the bottom and thereafter increases at a rate of approximately 3–4% for approximately the next four inches of the height of the mold wall such that at about eight inches from the top of the mold wall the apex of the curved mold wall facing extends about 0.1 inches from the vertical plane. This corresponds generally to the elevation 38 within the cavity. Thereafter, over the next approximately eight inches of vertical distance within the mold, the rate of change of the curvature of the mold wall gradually reduces to about 1% such that at approximately 12–14 inches down from the top of the mold, the apex of the mold wall curvature extends about 0.2 inches inwardly from the vertical plane. This corresponds generally to the elevation 40 within the mold cavity. Thereafter, over the next approximately eight inches of mold wall height, the rate of change of the curvature of the mold wall gradually decreases to about 0.5% such that at 24 inches down from the top of the mold, the thickness of the mold wall facing is about 0.25 inches measured inwardly from the vertical at the apex of the curved facing. This corresponds generally to elevation 42 within the mold cavity. Thereafter, the rate of curvature of the mold wall facing starts to increase to about 0.7% such that at the bottom of the mold wall cavity the thickness of the facing from the vertical is about 0.3 inches.

It must be understood, in considering the data given above that the rate of change of curvature of the mold wall should conform to the rate of contraction of the molten steel as the molten steel flows through the cavity. Thus, the precise curvature of the mold face may be varied depending upon the rate at which the molten steel is flowed through the mold as well as the nature of the cooling used for the mold. It should also be appreciated that the overall thickness of the facing from the vertical for the entire length of the mold is the same as when a linear taper at 1% has been provided.

Thus, the present invention provides a new approach to providing a tapered, curved mold wall convex facing where the degree of convexity increases at a non-linear and non-constant rate along the length of the mold from the top of the mold to the bottom of the mold thereby providing the outstanding results of the present invention.

It must be appreciated that the precise curve illustrated in FIG. 7 may require some modification depending upon the height of the mold which is used and thus the data given above should be considered and interpreted as representative and illustrative data rather than as limiting data.

The foregoing is a complete description of the preferred embodiment of the present invention. Various changes and modifications may be made without departing from the spirit and scope of the present invention. The invention, therefore, should be limited only by the following claims.

What is claimed is:

1. In a method of continuously casting metal including the steps of providing a continuous casting mold having a pair of opposed, spaced apart side plates and a pair of opposed, spaced apart end plates, said mold plates each having a facing, said side plate facings and said end plate facings defining a mold cavity therebetween, said mold cavity having open upper and lower ends, and continuously casting metal into the continuous casting mold by pouring molten metal into the open upper end of the cavity for cooling within said mold and for exiting from the open lower end of said mold cavity with a partially solidified skin, the improvement comprising:

said step of providing a continuous casting mold further including providing each facing of at least one pair of said opposed mold wall plates witha progressively increasing thickness between the open upper end of said cavity and the open lower end of said cavity with the rate of increase of said progressively increasing thickness being non-linear; and providing said facings with progressively increasing thicknesses of inwardly convex configuration.

2. The method as defined in claim 1 wherein the radius of curvature of said convex facing generally decreases at successive levels of the mold cavity from the upper end of the mold cavity to the lower end of the mold cavity.

3. The method as defined in claim 1 wherein said improvement further includes providing each facing of each of said opposed mold wall plates with a generally increasing thickness from the upper end of said mold cavity to the lower end of said mold cavity at said non-linear rate of increase.

* * * * *